United States Patent [19]

Samuelson

[11] Patent Number: 4,561,936

[45] Date of Patent: Dec. 31, 1985

[54] PROCESS FOR THE CONVERSION OF LIGNOCELLULOSIC MATERIAL TO CELLULOSE PULP BY ALKALINE PREOXIDATION FOLLOWED BY ALKALINE OXYGEN-FREE DIGESTION BOTH IN THE PRESENCE OF A REDOX ADDITIVE

[75] Inventor: Hans O. Samuelson, Gothenberg, Sweden

[73] Assignee: Mo och Domsjo Aktiebolag, Ornskoldsvik, Sweden

[21] Appl. No.: 295,923

[22] Filed: Aug. 24, 1981

Related U.S. Application Data

[63] Continuation-in-part of Ser. No. 77,443, Sep. 20, 1979, abandoned.

[30] Foreign Application Priority Data

Sep. 22, 1978 [SE] Sweden ..... 78.09959

[51] Int. Cl.[4] ..... D21C 3/02; D21C 3/04; D21C 3/20

[52] U.S. Cl. ..... 162/45; 162/72; 162/76; 162/90

[58] Field of Search ..... 162/19, 65, 72, 90, 162/38, 65, 76, 39, 45

[56] References Cited

U.S. PATENT DOCUMENTS

| | | | |
|---|---|---|---|
| 3,759,783 | 9/1973 | Samuelson et al. | 162/65 |
| 4,012,280 | 3/1977 | Hulton | 162/65 |
| 4,089,737 | 5/1978 | Nagano et al. | 162/38 |
| 4,091,749 | 5/1978 | Procter et al. | 162/72 |
| 4,127,439 | 11/1978 | Fujii et al. | 162/72 |
| 4,134,787 | 1/1979 | Eckert | 162/72 |

FOREIGN PATENT DOCUMENTS

| | | | |
|---|---|---|---|
| 986662 | 1/1973 | Canada | 162/72 |
| 2436845 | 5/1980 | France | 162/72 |
| 7712486 | 7/1979 | Sweden | 162/72 |

OTHER PUBLICATIONS

McCloskey et al., "Catalytic Influence of Iron and Magnesium Ions in Oxygen Blocking Reactions" *TAPPI*, vol. 58, No. 2, Feb. 1975.

*Primary Examiner*—Steve Alvo

[57] ABSTRACT

A two-stage process is provided for the conversion of lignocellulosic material, for instance, wood, to cellulose pulp, first oxidizing the lignocellulosic material to form aldonic acid end groups, preferably bound with 1,4-glycosidic bonds, in the polysaccharides, in an alkaline medium in the presence of the oxidized form of a redox additive which is converted into a reduced form in reaction with the wood and/or products formed from the wood, withdrawing the alkaline medium and then reoxidizing the reduced form of the redox additive in the absence of the lignocellulosic material at a rate to maintain the oxidized form of the redox additive in a major proportion in the alkaline medium during oxidation of the lignocellulosic material by contacting the withdrawn alkaline medium with oxygen-containing gas, and then continuing the digestion in an alkaline medium at a temperature within the range from about 160° to about 200° C., also in the presence of a redox additive, but without any addition of oxygen.

37 Claims, 1 Drawing Figure

Figure 1:
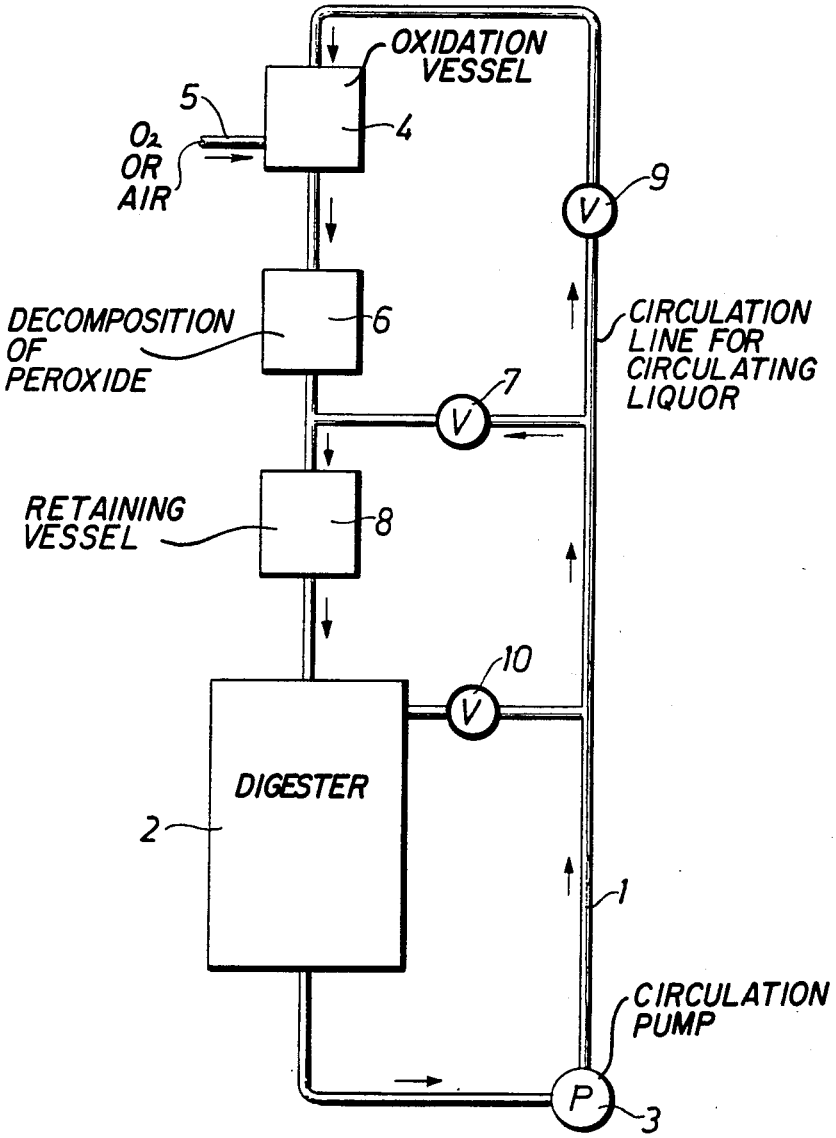

PROCESS FOR THE CONVERSION OF LIGNOCELLULOSIC MATERIAL TO CELLULOSE PULP BY ALKALINE PREOXIDATION FOLLOWED BY ALKALINE OXYGEN-FREE DIGESTION BOTH IN THE PRESENCE OF A REDOX ADDITIVE

This application is a continuation-in-part of Ser. No. 77,443 filed Sept. 20, 1979, and now abandoned.

TECHNICAL FIELD

The present invention relates to a process for digestion of lignocellulosic material in two stages using in each stage an alkaline digestion liquor admixed with at least one redox additive in an amount to increase the delignification rate in the second stage. Examples of lignocellulosic materials to which the invention is applicable include wood, preferably in the form of chips, but also including meal or groundwood, bagasse, straw, reed, jute and hemp. Any alkali such as potassium hydroxide and sodium hydroxide can be used, but usually sodium hydroxide is used. The process is a sulphur-free digestion, since no addition of sulphur in the form of sulphide is made. Small amounts of sulphur may be present during the process, originating from the lignocellulosic material itself, and possibly also from the redox additive, but such small amounts do not offer any problems.

SUMMARY OF THE STATE OF THE ART

U.S. Pat. No. 4,012,280 patented Mar. 15, 1977, and *TAPPI* 60:11 page 121 (1977) show that the rate of delignification is improved both in Kraft digestion and in NaOH digestion ("soda cooking") of wood, if to the digestion liquor one adds keto compounds and quinones such as anthraquinone, methyl anthraquinone, and anthrone, and that these compounds are superior to anthraquinone monosulphonic acid, which has been previously suggested by Bach and Fiehn (*Zellstoff und Papier* 1972 1, page 3). In all cases, the digestion is carried out without any addition of oxygen-containing gas before or during the digestion.

The addition of anthraquinone monosulphuric acid in oxygen delignification has been described by Sjöström (Swedish patent application 7603352-1), who digested birch powder and pine chips with oxygen in the presence of NaOH, and also bleached pine Kraft pulp with oxygen gas in the presence of NaOH. The improvement reported is very slight, in spite of addition of large amounts of the anthraquinone monosulphonic acid.

The influence of anthraquinone and anthraquinone derivatives in oxygen digestion and oxygen bleaching has been studied by the inventor herein, Samuelson, in published work done with Abrahamsson (*Svensk Papperstidning* 82 105 (1979) (March) and with Järrehult (*Svensk Papperstidning* 81 533 (1978) (November)), and found to be negligible. No benefit was noted in the delignification or in the carbohydrate yield. This result is understandable and expected, since it has been shown with comparatively great certainty that it is not the quinone-form of anthraquinone which accelerates the delignification in alkaline digestion of wood, in the absence of oxygen gas, but some reduced form (probably the hydroquinone form, formed by reduction). It is also known that blowing small amounts of oxygen through the digester during NaOH digestion of wood in the presence of anthraquinone leads to a significantly slower delignification than when no oxygen is added (See: Löwendahl and Samuelson, *TAPPI* 61:2, page 19 (1978) and Basta and Samuelson, *Svensk Papperstidning* 81, page 285 (1978)).

Moreover, certain oxidation agents are known to stabilize polysaccharides, especially hydrocellulose, which contain reducing sugar end groups against attack on the reduced end groups in alkaline medium (so-called peeling). Thus large additions of anthraquinone monosulphonic acid (50%) give a marked stabilization of hydrocellulose, but have a small effect in digestion of wood, as is shown by Bach and Fiehn in the above-mentioned paper.

As far as lignocellulosic materials, such as wood, are concerned, it has been shown that the presence of a large amount of anthraquinone during alkaline digestion leads to an increased carbohydrate yield, which at least to a certain extent can be related to an oxidation of the reducing sugar end groups. The amount of oxidation agent required is, however, very large. This may explain why this oxidation effect has not been observed by Holton, in his work related to digestion with the addition of anthraquinone, in spite of his knowing the works of Bach and Fiehn relating to anthraquinone monosulphonic acid.

The suggestion to save anthraquinone monosulphonic acid by having it present only during a pretreatment stage, before carrying out the main alkaline digestion according to the Kraft process, was made long before the results of Holton's investigations were known, by Worster and McCandless, Canadian Pat. No. 986,662. After the pretreatment, the spent liquor may be separated and reused after addition of fresh alkali and fresh anthraquinone monosulphonic acid. Spent liquor separated at the end of the pretreatment may also be subjected to an air oxidation, in order to convert anthrahydroquinone monosulphonate to anthraquinone monosulphonate. However, in spite of this, very large additions are required to obtain a noticeable improvement in yield. Additions of from 3 to 7% are said to be required, which means that the process therefore is too expensive to use in practice. Because sulphide disturbs the pretreatment, and has to be separated or eliminated, the spent liquor recovery system becomes so complicated that the process for this reason alone becomes impractical.

Worster and McCandless do not say and perhaps did not know why such large additions of anthraquinone monosulphonic acid are required. Recent studies (*Cellulose Chemistry and Technology,* No. 13, 357–362 (1979) edited by the Academy of the Socialist Republic of Romania), have demonstrated that anthraquinone monosulphonic acid is rapidly converted into the reduced form by reaction with the carbohydrates to form anthrahydroquinone monosulphonic acid, and that this form is slowly destroyed by reaction with the lignin. Thus, a large concentration is needed to be sure there is enough to last out the pretreatment, while by the end of the pretreatment there is very little of the reduced form left, for regeneration. The process is accordingly too inefficient for commercial use.

TECHNICAL PROBLEM

The digestion of lignocellulosic materials, such as wood, without using large amounts of sulphur compounds in the way presently used in cellulose mills would be advantageous both environmentally and in simplifying the system. However, sulphur-free digestion is applied only in a few mills, and is limited to NaOH digestion ("soda cooking") of hard wood, and the delignification is slow, and the quality of the pulp prepared and the pulp yield are each low. A more rapid delignification is obtained by the addition of redox additives such as anthraquinone. Since the redox additives are mainly destroyed in the digestion, and cannot be recovered or regenerated, this increases operating costs. As can be expected, the shortening of the digestion time achieved by addition of such additives leads to an increase in yield, because the carbohydrates have less time to be destroyed, but the effect is rather small when one uses only the small amounts of additive that are economically feasible. This is especially true when the known process is applied to softwood, e.g., pine. The problem of providing a technically and economically viable process for digestion of pine wood without using large amounts of sulphur compounds thus remains. Even for other lignocellulosic materials, it would be desirable to improve the process sufficiently to make it competitive with the Kraft process, which is noxious to the environment.

STATEMENT OF THE INVENTION

The present invention resolves the above problem, by subjecting the lignocellulosic material in a first stage to a preoxidation using an alkaline liquor at a temperature below 140° C., preferably within the range from about 15° to 130° C., and most preferably from 60° to 120° C., in the presence of at least one redox additive that is converted into a reduced form during reaction with the lignocellulosic material; withdrawing the reduced form of the redox additive with alkaline liquor and oxidizing the reduced form by oxygen gas in the absence of the lignocellulosic material at a rate sufficient to maintain the oxidized form of the redox addition in a major proportion and the reduced form in a minor proportion throughout the preoxidation. The redox additive in the oxidized form should have such a high solubility at the temperature used that the reducing sugar end groups in the lignocellulosic material are oxidized to aldonic acid end groups.

By maintaining a major proportion of redox additive in the oxidized form during the preoxidation, loss of the redox additive by reaction of the reduced form with the lignin is held to a minimum, and much less of the redox additive is required. In fact, the maximum amount of 2% is to be contrasted with the 3 to 7% of Worster and McCandless, and normally from 0.03 to 0.5% gives preferred results.

Thereafter, in a second stage the lignocellulosic material is converted to chemical cellulose pulp by delignification or alkaline digestion using strong alkali, preferably sodium hydroxide, in the presence of at least one redox additive, optionally the same one as during preoxidation, at a temperature within the range from about 160° to 200° C. without any addition of oxygen-containing gas, and preferably in the absence of oxygen, the oxygen present during preoxidation being removed and replaced by an oxygen-free inert atmosphere such as nitrogen.

The two-stage process of the invention provides an essentially sulphur-free digestion process that does not require oxygen during the second delignification stage, with a considerably shortened digestion time at high temperature in the second stage, when no oxygen is added, and with the use of very small amounts of delignification-improving additives, as compared to a similar two-stage process in which oxygen gas is replaced by nitrogen gas in the first stage, and therefore no oxygen is used at all in either stage. The invention thus makes it possible to manufacture pulp in a high yield with a low addition of the expensive redox additive.

It is not yet possible to explain the effect observed, but it seems probable that there is a connection with the fact that the preoxidation conditions are favorable for oxidation of reducing sugar end groups in the polysaccharides to aldonic acid end groups, especially with 1,4-glycosidic bonds, which are more stable in alkaline medium at high temperatures than are 1,3-glycosidic bonds.

FIG. 1 represents a flow sheet showing apparatus used in carrying out the process of the invention exemplified in Example 1.

The process of the invention furthermore makes it possible to use redox additives that are reoxidized by oxygen and whose oxidized form is so stable that they can be reused almost indefinitely.

While some up to 20% of the delignification or digestion can occur during the preoxidation stage according to the invention, the main part of the delignification or digestion, at least 80%, preferably from 85 to 99% and most preferably from 92 to 98%, takes place during the second stage digestion, where oxygen-containing gas is not added, either to the digestion zone or to the digestion liquor being added to the digestion zone, and preferably is not present.

Under the preoxidation conditions according to the invention, oxidation of the reducing sugar end groups of the lignocellulosic materials converts them to aldonic acid end groups, preferably such groups that have a glycosidic bond in the $\gamma$-position in relation to the carboxylic group, i.e., that are bound to the polysaccharide with 1,4-glycosidic bonds. Such groups are gluconic acid and mannonic acid end groups formed in glucomannan and cellulose without any cleavage of the carbon-carbon bonds in the terminal reducing sugar unit and xylonic and lyxonic acid end groups, which in similar way are formed from terminal xylose units in xylan. In order to obtain the best results, the preoxidation conditions should not favor the formation of arabinonic acid end groups and other pentonic acid end groups in glucomannan and cellulose by fragmentation of terminal units, so as to restrict these reactions to a low level, and so that the formation of tetronic acid end groups in xylan will be low. Pentonic acid end groups in glucomannan and cellulose and tetronic acid end groups in xylan are bound to the polysaccharides with 1,3-glycosidic bonds, which has been shown to be disadvantageous in the process of the invention.

Oxygen gas oxidation in the absence of a redox additive gives a large amount of 1,3-bound aldonic acid end groups. Under certain conditions, for instance at low temperature and high alkali addition, these groups will wholly dominate. Oxidation with oxygen gas in combination with a redox additive can, however, be carried out so that at least 60%, preferably from 80 to 100%, of the aldonic acid end groups formed in glucomannan and cellulose as well as xylan are bound with 1,4-glycosidic bonds to the polysaccharides.

The preoxidation liquor is alkaline. While any strong alkali such as potassium hydroxide or sodium hydroxide can be used, normally the alkali will be sodium hydroxide in a concentration of from 0.1 to 2 moles per liter, and usually 0.5 to 1 mole per liter. In order to avoid unnecessary carbohydrate losses, the preoxidation is carried out at a temperature of at most 140° C., and preferably within the range from about 15° to about 130° C. Low temperatures require a long retention time. Furthermore, some redox additives may have too low a solubility at low temperatures to give the desired oxidation effect. These factors are well balanced at temperatures within the preferred temperature range of from 60° to 120° C. At 80° C., a treatment time of two hours has given better results than a treatment for one hour, whereas at 100° C. a treatment for one hour has been shown to be satisfactory. At higher temperatures, the time can be further decreased.

In order to obtain formation of substantially 1,4-bound aldonic acid end groups without serious depolymerization or degradation of cellulose and hemicellulose and a high pulp yield, it is important that the regeneration of the reduced form of the redox additive in the preoxidation liquor with oxygen-containing gas, for instance air, or pure oxygen gas, be carried out in the absence of the lignocellulosic material. Regeneration in the presence of the lignocellulosic material is definitely disadvantageous.

Regeneration is best done outside the reactor or the reaction zone in which the lignocellulosic material is present during the preoxidation. The treatment can take place in a separate vessel, or in a recirulation line which withdraws and then returns the preoxidation liquor to the preoxidation zone. The liquor circulation rate is high enough to recycle the reduced form of redox additive repeatedly, on the average at least two times, and for instance, from 10 to 100 times, during the preoxidation, so as to maintain the oxidized form of the redox additive present in a major proportion.

The oxygen-containing gas should be given sufficient time to react with the reduced form of the redox additive in the preoxidation liquor before the liquor is recycled to the lignocellulosic material. Therefore it is suitable to provide one or more holding vessels in the circulation line through which the liquor is recycled. The retention time in these vessels may for instance be one minute, but longer or shorter retention times, for instance from ten seconds to sixty minutes, can be used, according to the need.

Prolonged retention time also permits decomposition of peroxide formed in the regeneration of the oxidized form of the redox additive. Since peroxide may reduce pulp strength, this is especially desirable in the preparation of cellulose pulp with high strength requirements. The decomposition of peroxide can be accelerated by known techniques, for instance, by letting the liquor pass through packed towers or parallel-coupled pipes of a large surface area.

According to one embodiment of the invention, before recycling, the preoxidation liquor after the treatment with oxygen-containing gas is treated with a catalyst that decomposes peroxide. As the catalyst, one can use, for instance, platinum, silver, manganese, or manganese compounds such as manganese oxide. Iron oxide and other known catalysts (for instance those described in the ACS-monograph Hydrogen Peroxide by Schumb, Sutterfield, Wentworth (Reinhold New York 1955)) can also be used.

Oxygen is formed in the decomposition of peroxide, and to avoid waste this liquor from the peroxide decomposition step before it is recycled can be mixed with unoxidized preoxidation liquor.

Most redox additives suitable for use during the preoxidation stage are oxidized easily even at low partial pressure of oxygen gas. Air of atmospheric pressure can advantageously be used. Low pressure is generally preferred, so that unnecessarily large amounts of oxygen gas are not dissolved in the liquor, or come into contact with the lignocellulosic material. A partial pressure of oxygen of less than 0.1 bar is generally preferred instead of a higher pressure. The oxygen consumption is usually low, and normally corresponds in oxidation equivalents to at least 2 times, and usually 10 to 200 times, the amount of redox additive present during the preoxidation. These figures apply to the case where excess oxygen is used up; more may be needed if excess oxygen is vented. In practice, it is possible to so regulate the process that a desired oxygen consumption is obtained.

It has surprisingly been found that degradation inhibitors which decrease the depolymerization of carbohydrates in oxygen bleaching have a favorable influence in the process of the invention, if these inhibitors are present during preoxidation. Such inhibitors contribute to an increased pulp yield at the same Kappa number of the prepared cellulose pulp. An increased viscosity can be observed even in the case where the delignification is significantly retarded by the degradation inhibitor, which retardation is of course an unwanted side effect.

With sawdust, wood meal, and other finely divided lignocellulosic materials, precipitated magnesium hydroxide has given significant beneficial effects. Wood chips and similar large particles have to be impregnated with inhibitor, for instance, a magnesium salt or a magnesium complex, if the inhibiting effect is to be utilized to the full extent. Other inhibitors include complexing agents for transition metals, for instance, aminopolycarboxylic acids, ethanolamines, other amines, for instance ethylene diamine, polyphosphates and other known complex formers. These can be used with or in replacement of magnesium compounds. Any of the degradation inhibitors of the following patents can be used: U.S. Pat. Nos. 3,769,152 patented Oct. 30, 1973, U.S. Pat. No. 3,764,464 patented Oct. 9, 1973, U.S. Pat. No. 3,759,783 patented Sept. 18, 1973, U.S. Pat. No. 3,701,712 patented Oct. 31, 1972, and U.S. Pat. No. 3,652,386 patented Mar. 28, 1972. The disclosures of these patents are hereby incorporated by reference.

Suitable redox additives for use in the second stage of the process of the invention, the alkaline digestion at a temperature within the range from about 160° to about 200° C. without the addition of oxygen, i.e., in the absence of oxygen, can be any of those conventionally used in soda digestion, kraft digestion and polysulphide digestion in order to accelerate the digestion. Exemplary such compounds are those described in U.S. Pat. No. 4,012,280 to Holton, patented Mar. 15, 1977, carboxylic aromatic and heterocyclic quinones including naphthoquinone, anthraquinone, anthrone, phenanthraquinone and alkyl-, alkoxy- and amino-derivatives of these quinones 6,11-dioxo-1H-anthra(1,2-c)pyrazole; anthraquinone-1,2-naphthacridone; 7,12-dioxo-7,12-dihydroanthra(1,2-b)pyrazone, benzanthraquinone and 10-methyleneanthrone.

Also useful are the diketohydroanthracenes which are unsubstituted and lower alkyl-substituted Diels-Alder addition products of napthoquinone or benzoquinone, described in U.S. Pat. No. 4,036,681, patented July 19, 1977.

More particularly, the unsubstituted Diels-Alder adducts are those obtained by reacting 1 or 2 mols of butadiene with naphthoquinone and benzoquinone, respectively, and the lower alkyl-substituted adducts are those obtained where in the above reaction either one or both of the reactants are substituted with the appropriate lower alkyl groups. The alkyl groups in the lower alkyl-substituted Diels-Alder adducts may range in number from 1 to 4, may each contain from one to four carbon atoms and may be the same or different. Examples of the above diketo anthracenes are 1,4,4a,5,8,8a,-9a,10a-octahydro-9,10,diketo anthracene, 2,3,6,7-tetramethyl-1,4,4a,5,8,8a,9a,10a-octahydro-9,10-diketo anthracene, 1,4,4a,9a-tetrahydro-9,10-diketo anthracene, 2-ethyl-1,4,4a,9a-tetrahydro-9,10-diketo anthracene and 2,3-dimethyl-1,4,4a,9a-tetrahydro-9,10-diketo anthracene, and 1,3-dimethyl,1,4,4a-9a-tetrahydro-9,10-diketo anthracene.

Also suitable are the quinones and hydroquinones having the formula:

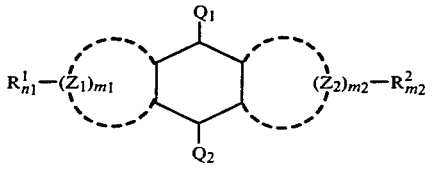

where:

$Q_1$ and $Q_2$ are both $$\overset{\overset{\displaystyle H}{|}}{O} \text{ or } \overset{\overset{\displaystyle O}{\|}}{O};$$

$Z_1$ and $Z_2$ if present are aromatic or cycloaliphatic carbocyclic rings condensed with the carbocyclic ring nucleus of the compound; and $m_1$ and $m_2$ are the number of such $Z_1$ and $Z_2$ groups on the benzene nucleus, and can be from zero to two.

When $Q_1$ and $Q_2$ are both =O the compound is a quinone, and when $Q_1$ and $Q_2$ are both —OH the compound is a hydroquinone.

When $Z_1$ is a carbocyclic aromatic ring and $Q_1$ and $Q_2$ are =O, the compound is a naphthoquinone, and when $Z_1$ is a carbocyclic aromatic ring and $Q_1$ and $Q_2$ are —OH, the compound is a naphthohydroquinone.

When both $Z_1$ and $Z_2$ are carbocylic aromatic rings and $Q_1$ and $Q_2$ are =O, the compound is an anthraquinone, and when $Z_1$ and $Z_2$ are carbocyclic aromatic rings and $Q_1$ and $Q_2$ are —OH, the compound is an anthrahydroquinone.

$R_1$ and $R_2$ are substituents in the benzene or $Z_1$ and $Z_2$ nuclei, and can be hydrogen, hydroxyl, hydroxyalkyl, hydroxyaryl (phenolic), alkyl, acyl, and carboxylic acid ester having from one to about ten carbon atoms, and $n_1$ and $n_2$ are the number of such $R_1$ and $R_2$ groups and can be from zero to four.

Quinone (benzoquinone) and hydroquinone (paradihydroxy benzene) are exemplary. The naphthalene compounds, such as naphthoquinone and naphthohydroquinone, have given better results than the benzene compounds. Even better results are obtained with the anthracene compounds. Particularly suitable is anthraquinone, which has been found to be effective and very stable during each pulping stage. Anthrahydroquinone can also be used, and has the advantage of higher solubility in the pulping liquor than anthraquinone. Also useful are monohydroxy anthraquinones and 1,2-, 1,4-, 1,5-, and 1,8-dihydroxy anthraquinone, hydroxymethyl anthraquinone, hydroxyethyl anthraquinone, hydroxyethyl anthrahydroquinone, hydroxymethyl anthrahydroquinone, 1-methylanthraquinone, 2-methylanthraquinone, 1-ethylanthraquinone, 2-ethylanthraquinone, 1-aminoanthraquinone, 2-aminoanthraquinone, 1,5-diaminoanthraquinone, as well as the corresponding anthrahydroquinones, and anthraquinones and hydroxy anthraquinones having one or more carboxylic acid groups bonded either directly to an aromatic ring or via an alkylene chain bonded to an aromatic ring.

The quinone or hydroquinone can be a mixture containing several quinones, hydroquinones and sulfur-free derivatives thereof. For reasons of economy, the compounds can be made from raw materials which have not been subjected to any extensive purification.

High chemical resistance during the prevailing reaction conditions is also important.

Especially suitable are anthraquinone, methylanthraquinones and ethylanthraquinones. Hydroxymethyl- and hydroxyethylanthraquinones are also suitable.

The redox additive used during the preoxidation stage of the process according to the invention should also be capable of being reduced in a series of reactions in the course of which the oxidation of reducing sugar end groups of the lignocellulosic to aldonic acid end groups is one necessary reaction, and reoxidized by treatment of the preoxidation liquor with an oxygen-containing gas. The redox additive should also be capable of being rapidly oxidized by an oxygen-containing gas under the preoxidation conditions, that is, at a temperature below 140° C., suitably at from about 15° to about 130° C., and preferably at from 60° to 120° C. The redox additive should be repeatedly converted from reduced to oxidized form by treatment with oxygen gas. At the temperature used it must be so soluble that it can convert reducing sugar end groups in the lignocellulose to aldonic acid end groups.

Compounds which can oxidize reducing sugars, for instance glucose, in alkaline medium so that aldonic acids are formed, and are thereby reduced to a form which is reoxidized when the preoxidation liquor is treated with oxygen gas at atmospheric pressure, can be used as redox additives in the preoxidation. While hypochlorite can oxidize both glucose and glucose end groups in polysaccharides, hypochlorite does not fulfill the requirement of being reoxidizable with oxygen gas. This requirement is, however, fulfilled by the carbocyclic aromatic diketones mentioned above as useful in the alkaline digestion stage, such as quinone compounds, which can be added in the oxidized quinone form or in the reduced hydroquinone form, for instance, as hydroquinone compounds, i.e., aromatic compounds with preferably two phenolic hydroxy groups. Thus, anthraquinone, methylanthraquinone and ethylanthraquinone, which are among the best known accelerators for the delignification and the digestion of sawdust and technical wood chips, can be used to advantage in the preoxidation stage, when sawdust is used as the raw material. However, these compounds give far from optimal results in the preoxidation stage, when wood chips are used as the raw material.

The reason is, that these compounds have too low a solubility in the preoxidation liquor to give a rapid enough oxidation of reducing sugar end groups in the inner parts of the chips. The particle size of the lignocellulosic material controls the diffusion distances that have to be traversed by the additive for the reaction to be as complete as possible. These additives can be suitable at short diffusion distances, but not at long diffusion distances.

Accordingly, in the preoxidation stage, it is preferred to use redox additives that in the oxidized form during the preoxidation contain hydrophilic groups which can enhance the solubility of the additives in the preoxidation liquor.

In applying the process of the invention for digestion of large particulate lignocellulosic material such as wood chips, it is especially suitable in the preoxidation stage to use one or more redox additives that are more hydrophilic than anthraquinone. Anthraquinone derivatives having a hydrophilic group, for instance, a sulphonic acid group, directly bound to an aromatic ring can be used, but one obtains even better results if the hydrophilic group is in an aliphatic side chain. Exemplary of such compounds are anthraquinones with one or more hydroxy methyl and/or hydroxy ethyl and/or carboxylic groups bound to a methylene group, for instance, carboxymethyl and/or carboxyethyl groups as well as anthraquinones having one sulphonic acid group in an aliphatic side chain.

Also derivatives of naphoquinone with hydrophilic substituents can be used to advantage. Especially suitable are naphthoquinones which have been substituted in the 2- and 3-positions either with these substituents or in addition with for instance a methyl and/or ethyl group.

This explains why one obtains an optimal result, calculated at constant addition in moles of the redox additive, if one uses a hydrophilic redox additive in the preoxidation stage, and a nonhydrophilic redox additive in the digestion stage at from 160° to 200° C. While it is especially suitable with wood chips for instance to use a hydrophilic additive, this is not of the same importance when the lignocellulosic material is sawdust.

After the preoxidation stage some or all of the preoxidation liquor is suitably removed and reused in the preoxidation of freshly-added lignocellulosic material, either batchwise or in a continuously operated process. Preferably, as large an amount as possible of preoxidation liquor is removed, and reused for the preoxidation of new lignocellulosic material, desirably after replenishing the redox additive and the alkali, by adding for instance sodium hydroxide, and the additive.

Washing of the lignocellulosic material and pressing of the same may be applied after the preoxidation but normally neither washing nor pressing is necessary. As a consequence, a significant amount of spent preoxidation liquor from the preoxidation stage is normally transferred to the alkaline digestion stage.

One should take this fact in consideration when choosing a redox additive for the preoxidation. Additives which are effective in both the preoxidation and the digestion stages therefore are to be preferred. Anthraquinone-2-monosulphonic acid, which while suitable for the preoxidation stage with added oxygen gas has only a small effect in the alkaline digestion stage, is not an ideal redox additive for this reason. Instead, hydrophilic redox additives, especially those with one or two hydroxyl and/or carboxylic groups in an aliphatic side chain, are effective in both the preoxidation and digestion stages, and are preferred. However, the hydrophilic additives are more expensive than the nonhydrophilic additives such as anthraquinone or methylanthraquinone. Therefore, to reduce costs, a mixture of hydrophilic and hydrophobic additives can be used. The hydrophilic additive can be present in the preoxidation stage, and a hydrophobic additive such as anthraquinone or methylanthraquinone can be added either for the preoxidation stage or only for the digestion stage. The preferred compromise with the prices valid at present is anthraquinone-2-monosulphonic acid in the first stage and anthraquinone added first in the second stage.

Because the reduced form of the redox additive is reoxidized soon enough that it is present only in a minor proportion, and the oxidized form in a major proportion, much less redox additive is needed than in the Worster and McCandless process, and less is lost in side reactions with the lignin.

The amount of redox additive for the preoxidation stage and in the digestion stage can be rather small, and should be within the range from about 0.01 to 2% by weight, preferably from about 0.03 to about 0.5%, and most preferably from about 0.05 to about 0.2% based on dry lignocellulosic material.

The ratio of lignocellulosic material to liquor can in both stages vary between 1:2 and 1:30. The total addition of alkali, preferably NaOH, in both stages should be at least 10%. A suitable addition for the preparation of bleachable pulp from wood is within the range from about 20 to about 30% NaOH, based on the dry weight of the wood.

The influence of the preoxidation stage in the process of the invention on the yield, the delignification (Kappa number) and viscosity has been investigated. Especially reproducible results have been obtained with wood meal or sawdust.

The following Examples represent preferred embodiments of the invention, in the opinion of the inventor:

EXAMPLE 1

In this Example, the apparatus shown in FIG. 1 was used.

To a cellulose digester 2 for digestion of wood chips provided with a circulation pump 3 and with a circulation line 1 was connected an oxidation vessel 4 provided with a line 5 for blowing an accurately measured amount of finely divided oxygen gas or air into the vessel. The preoxidized liquor was passed to a vessel 6 for the decomposition of peroxide filled with a packing comprising pieces of acid-resistant steel. The liquor coming from this vessel was mixed with an untreated portion of the circulating liquor in a ratio of about 1:1. The proportioning was regulated by means of valve 7. The liquor mixture was held in the retaining vessel 8, so that the remaining oxygen and/or peroxide would be consumed before the preoxidation liquor was recirculated to the digester.

Initially, the liquor is colorless, but quickly becomes yellowish, and then gradually light brown. A red color can easily be observed if imposed upon the yellow to light brown color of the liquor.

The circulation of the liquor was regulated so that every five minutes a liquor volume corresponding to the volume in the system was circulated. In this way, a major proportion of the redox additive was maintained in the oxidized form, and the liquor that was circulated remained yellowish, and towards the end of the preoxidation, light brown, both on entering and on leaving the oxidation vessel 4. The volume of liquor in each of the vessels 4, 6 and 8 was 10% of the volume of the digester.

Oxygen gas was added in such an amount that the consumption was 20 moles per 100 kgs of dry wood.

Preoxidation was carried out at a wood:liquor ratio of 1:5. The wood consisted of technical pine chips. Anthraquinone-2-monosulphonic acid in an amount of 0.2% by weight based on the dry weight of the wood was used as the redox additive. The temperature, which at the start was 80° C., was increased over 120 minutes to 100° C.

After the preoxidation, 0.2% of anthraquinone based on the dry weight of the wood was added. The valves 7 and 9 were closed, and the valve 10, which had been closed during the preoxidation, was opened. The temperature was increased to 170° C. over 70 minutes. When the temperature has reached 103° C., the digester was emptied of gas for three minutes. The digestion at 170° C. was carried out for 120 minutes.

A pulp having a Kappa number of 45 and a viscosity of 955 $dm^3/kg$ was obtained. The yield was 49.7%.

Control digestions were carried out in which the preoxidation was omitted. Compared at the same Kappa number, when using the preoxidation according to the invention one obtained the same viscosity as in the controls but at a 3% lower consumption of wood.

The Example shows that excellent results can be obtained when applying the preoxidation of the invention on technical pine chips, in which the oxygen-containing gas is added to the preoxidation liquor in a preoxidation vessel separate from the digester, and that anthraquinonemonosulphonic acid, which has a low effect on the delignification velocity, has an effect in the preoxidation according to the invention which is reflected in an increased yield of pulp.

EXAMPLE 2

In a digester with a volume of 25 $dm^3$ industrial chips from spruce or birch were pretreated with a liquor containing sodium hydroxide and anthraquinone-2-monosulphonic acid. By means of a centrifugal pump the liquor was passed via a heat exchanger into an oxygen reactor with a volume of 25 $dm^3$ and back again to the digester. Pure oxygen at atmospheric pressure was passed through the liquor in the oxygen reactor. The liquor entering the reactor was red and the liquor leaving the reactor was yellow to a light brown in color, according to the stage of the preoxidation. The flow of oxygen was regulated so that no red color imposed on the yellow to light brown color could be observed by visual inspection of liquor samples withdrawn after the oxygen reactor. The rate of circulation was such that a major proportion of the redox additive anthraquinone-2-monosulphonic acid was maintained in the oxidized form.

The addition of anthraquinone-2-monosulphonic acid was 0.37% and the sodium hydroxide 20 to 24% in different runs, calculated on dry wood. The ratio liquor:wood was 7:1. The pretreatment was made at 97° C. After the pretreatment the oxygen reactor was disconnected from the digester and 0.25% anthraquinone added to the chips in the digester. The liquor was heated, gas released and the cooking carried out at 170° C. Blanks were made in which the oxygen in the oxygen reactor was substituted for nitrogen during the pretreatments.

With spruce chips, subjected to pretreatment for two hours, the yield of the final pulp compared at the same Kappa number was 0.5 to 0.7% higher when oxygen was present than in the blanks under nitrogen. This corresponded to a decrease in wood consumption of 1.0 to 1.4%. Compared on the same basis the intrinsic viscosities were 40 to 80 $dm^3/kg$ lower when the pretreatment was made under oxygen.

With birch chips, the duration of the pretreatment was extended to four hours. The presence of oxygen resulted in an increase in yield of approximately 1.2% and a loss in viscosity of about 30 $dm^3/kg$. The results show that the stabilization of the carbohydrates was favored when oxygen was present during the pretreatment and that the effect on the final yield was in part offset by the consecutive peeling following the cleavage of the carbohydrate molecules. The results show that a further improvement can be achieved if the process is modified so that the depolymerization of the cellulose is suppressed.

EXAMPLE 3

In a digester heated in a polyglycol bath, thin chips from spruce were pretreated with a liquor containing sodium hydroxide and anthraquinone-2-monosulphonic acid. To obtain a zone from which clear liquor could be withdrawn a cone made of wire netting (stainless steel) was placed on the bottom of the digester. By means of a peristaltic pump the clear liquor was pumped from the digester to an oxygen reactor, where it was treated in a stream of oxygen (0.4 l/min). This value and all other additions given below are calculated on 100 g dry wood. In some runs, the reactor contained a platinum net (130 g; 750 $cm^2$) serving as a catalyst for the decomposition of hydrogen peroxide formed during the oxidation of the reduced anthraquinone-2-monosulphonic acid with oxygen. The liquor was then passed into a peroxide decomposition vessel containing another platinum net (260 g; 1500 $cm^2$). Nitrogen (0.4 l/min) was bubbled into this vessel to remove dissolved oxygen and the oxygen formed by decomposition of the hydrogen peroxide. Finally, the liquor was returned to the digester.

To obtain a uniform composition of the liquor in the digester and to remove oxygen which had not been displaced in the peroxide decomposition vessel a stream of nitrogen (1.3 l/min) was passed into the digester. To improve the mixing the solution under the funnel was stirred magnetically. The gas leaving the reaction vessels was passed through reflux coolers to suppress the losses of water during the pretreatment.

The addition of anthraquinone-2-monosulphonic acid was 0.37 g. The pretreatment was made at 90° C. for sixty minutes in 6 liters of 0.6M NaOH. After the pretreatment the liquor was removed and the wood was transferred to a digester. After addition of 4 liters of 0.6M NaOH and 0.5 g anthraquinone the digester was heated, gas released and the cooking carried out at 170° C.

In the runs where platinum netting serving as a catalyst for the decomposition of peroxide was present both in the oxygen reactor and in the peroxide decomposition vessel, so as to decompose the peroxide formed during the oxygen treatment and to remove oxygen from the liquor before it was brought in contact with the wood chips, the liquor was, during the pretreatment, circulated between the digester and the oxygen reactor at a rate of 1.5 l/min. The inlet tube for the liquor ended below the liquor surface in the oxygen reactor, and oxygen was passed through the liquor as fairly large bubbles. Blanks were made in which the liquor was treated with nitrogen instead of oxygen in the oxygen reactor. Other blanks were made without contact between platinum and liquor by circulating the liquor through the bypass tube.

The total yield of final pulp as a function of the Kappa number for chips pretreated with anthraquinone-2-monosulphonic acid and then cooked at 170° C. under nitrogen for 90, 120, 160 and 240 minutes was significantly increased by pretreatment with oxygen compared to Controls with pretreatment under nitrogen. The Controls in which the liquor was brought in contact with the platinum netting but not with oxygen gave the same results as those without contact between the liquor and platinum.

Compared at any given Kappa number the improvement in yield was 1.2 to 1.5% which corresponds to a decrease in wood consumption by 2.5 to 3.5%.

The influence of oxygen during the pretreatment on the cooking time required to reach a desired lignin content was small, and within the limits of experimental error. Accordingly, the dissolution of carbohydrates was retarded as a result of the presence of oxygen during the pretreatment. This is explained by an increased oxidation of reducing sugar end groups to aldonic acid end groups.

The viscosity of the pulp at any given Kappa number was lower in the experiments with oxygen treatment of the liquor at 90° C. than in the Controls. The difference (30 to 40 $dm^3/kg$) was larger than that expected from the higher hemicellulose content (reflected in the higher yield). Compared to the severe depolymerization by oxygen in direct contact with the wood (e.g. 200 $dm^3/kg$), the loss in viscosity due to the oxygen treatment was small under the applied conditions. The results suggest that the exclusion of peroxide and oxygen from the digester was not complete, although precautions were taken to decompose peroxide on platinum, and to exclude oxgyen by treatment with nitrogen in the peroxide decomposition vessel and the digester. Evidently, the consecutive peeling, which occurs after the cleavage of the carbohydrate molecules, was more severe in the experiments with oxygen pretreatment than in those under nitrogen. The results indicate that a complete exclusion of peroxide and oxygen would lead to somewhat higher yields than those obtained in this series of experiments.

Initially, the liquor is colorless, but quickly becomes yellowish, and then gradually light brown. A red color can easily be observed, if imposed upon the yellow to light brown color of the liquor. During the pretreatment, the yellow to brown liquor circulated to the reactor from the digester became distinctly red when the temperature reached 80° C., due to the formation of anthrahydroquinone. The red color disappeared during the treatment with oxygen in the oxygen reactor, due to the oxidation of the reduced or hydroquinone form of the additive to the oxidized or quinone form.

Next, the liquor circulation rate between the digester and the reactor was increased to 2 l/min, and a more intimate contact between the oxygen and the liquor in the oxygen reactor was achieved. The liquor level in the oxygen reactor was therefore lowered so that the inlet tube for the circulating liquor ended in the gas phase. Under these conditions, oxygen was sucked into the tip by the pulsations of the peristaltic pump, and together with liquor from the digester blown into the liquor present in the oxygen reactor. This led to a fine dispersion of oxygen in the liquor. In this series, platinum netting was present only in the peroxide decomposition vessel. The treatment was so effective that the liquor in the digester and circulated to the oxygen reactor remained yellow to light brown, depending upon the stages of the pretreatment, and no significant difference in color of the liquor entering and leaving the oxygen reactor could be observed visually. The final cooking was made with addition of anthraquinone, under the same conditions as used in the previous series.

The dissolution of carbohydrates was strongly retarded in these experiments. Evidently, the carbohydrates were stabilized effectively towards endwise degradation. The influence of this oxygen treatment on the delignification was insignificant. Although a somewhat lower viscosity was obtained at a given Kappa number, the yield of pulp compared at a given Kappa number was approximately 2% higher when oxygen was brought in contact with the circulating liquor during the pretreatment with anthraquinone-2-monosulphonic acid than in the Controls under nitrogen. This corresponds to a decrease in wood consumption by 4.5 to 5%.

In the last series of experiments, the observed recovery of anthraquinone-2-monosulphonic acid after the pretreatment was between 95 and 102%. The high stability of anthraquinone-2-monosulphonic acid under applied conditions makes it possible to recirculate spent liquor from this stage and use the additive again for the stabilization of carbohydrates.

ADVANTAGES

The primary advantages of the process of the invention as compared to Kraft digestion using redox additives is that one avoids the use of poisonous and ill-smelling gases and liquors, as well as the liberation of acidic sulphur compounds. The pulp yield is higher than in Kraft digestion.

When compared to NaOH-cooking ("soda cooking") with redox additives, the process of the invention at the same yield of cellulose pulp requires a much lower redox additive concentration, and also consumes less redox additive, normally one-tenth as much, in side reactions. If the comparison is made at the same amount of redox additive, one obtains a remarkable increase in yield, compared at the same lignin content of the cellulose pulp. Because regeneration of redox additive is carried out in the absence of lignocellulosic material, if the peroxide formed in regeneration is destroyed, one also obtains a pulp with a higher viscosity that gives a higher strength paper.

Having regard to the foregoing disclosure the following is claimed as the inventive and patentable embodiments thereof:

1. A process for the essentially sulphur-free delignification of particulate lignocellulosic material that does not require oxygen during the delignification stage, with a short digestion time at high temperature, which comprises:

(1) subjecting the lignocellulosic material to a preoxidation using an alkaline liquor at a temperature below 140° C. in the presence of at least one redox additive that is converted into a reduced form during reaction with the lignocellulosic material;

(2) withdrawing the reduced form of the redox additive with alkaline liquor and oxidizing the reduced form by oxygen gas in the absence of the lignocellulosic material at a rate sufficient to maintain the oxidized form of the redox additive in a major proportion and the reduced form in a minor proportion throughout the preoxidation;

(3) continuing the preoxidation so that reducing sugar end groups in the lignocellulosic material are oxidized to aldonic acid end groups; and (4) then converting the lignocellulosic material to chemical cellulose pulp by delignification using strong alkali in the presence of at least one redox additive at a temperature within the range from about 160° to 200° C. without any addition of oxygen-containing gas.

2. A process according to claim 1 in which the temperature during the preoxidation is within the range from about 15° to 130° C.

3. A process according to claim 2 in which the temperature during the preoxidation is within the range from about 60° to 120° C.

4. A process according to claim 1 in which the preoxidation conditions are favorable for oxidation of reducing sugar end groups in the polysaccharides to aldonic acid end groups with 1,4-glycosidic bonds.

5. A process according to claim 1 in which at least 80% of the delignification takes place during stage (4) where oxygen-containing gas is not added.

6. A process according to claim 1 in which in the stage (4) delignification the oxygen is removed and replaced with an oxygen-free inert gas atmosphere.

7. A process according to claim 1 in which the alkali in the alkaline preoxidation liquor is sodium hydroxide in a concentration of from 0.1 to 2 moles per liter.

8. A process according to claim 1 in which in stage (2) the preoxidation liquor is withdrawn and circulated continuously to and from a place where the liquor is treated with oxygen-containing gas at a liquor circulation rate high enough to recycle the oxidized form of redox additive repeatedly from 10 to 100 times during the preoxidation.

9. A process according to claim 1 in which in stage (2) the preoxidation liquor is withdrawn and circulated continuously to and from a place where the liquor is treated with oxygen-containing gas at a liquor circulation rate high enough to prevent development of a color arising from presence of the reduced form of the redox additive.

10. A process according to claim 1 in which after oxidation in stage (2) the liquor is held for a sufficient time within the range from 10 seconds to 60 minutes to permit the oxygen-containing gas to react with the reduced redox additive in the preoxidation liquor before the liquor is recycled to the lignocellulosic material.

11. A process according to claim 10 in which retention time is prolonged to permit decomposition of peroxide formed in the regeneration of the redox additive.

12. A process according to claim 10 in which before recycling the preoxidation liquor after the treatment with oxygen-containing gas is treated with a catalyst that decomposes peroxide.

13. A process according to claim 12 in which the catalyst is platinum.

14. A process according to claim 12 in which liquor from the peroxide decomposition step is mixed with unoxidized preoxidation liquor and then recycled.

15. A process according to claim 1 in which the oxygen-containing gas is oxygen.

16. A process according to claim 1, in which a degradation inhibitor which decreases the depolymerization of carbohydrates in oxygen bleaching is present during the preoxidation.

17. A process according to claim 16, in which the degradation inhibitor is a magnesium compound.

18. A process according to claim 16 in which the lignocellulosic material is impregnated with inhibitor.

19. A process according to claim 16 in which the inhibitor is selected from the group consisting of magnesium salts, magnesium hydroxide, magnesium complexes, amino polycarboxylic acids, amino polyphosphonic acids, alkanolamines, polyamines, and polyphosphates.

20. A process according to claim 1 in which the redox additive is selected from the group consisting of carbocyclic aromatic quinones and hydroquinones.

21. A process according to claim 20, in which the quinone is selected from the group consisting of naphthoquinone, anthraquinone, anthrone, phenanthraquinone and alkyl-, alkoxy- and amino-derivatives of these quinones.

22. A process according to claim 1 in which the redox additive is selected from the group consisting of anthraquinone monosulphonic acids, anthraquinone disulphonic acids, alkali metal salts of said acids, and mixtures of said acids and salts.

23. A process according to claim 1 in which the redox additive is a quinone or hydroquinone having the formula:

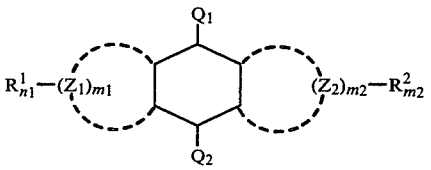

wherein $Q_1$ and $Q_2$ are both

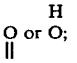

$Z_1$ and $Z_2$ if present are aromatic or cycloaliphatic carbocyclic rings condensed with the carbocyclic ring nucleus of the compound: $R^1$ and $R^2$ are selected from the group consisting of hydrogen, hydroxyl, hydroxyalkyl, hydroxyaryl, alkyl, acyl, and carboxylic acid ester having from one to about ten carbon atoms; $n_1$ and $n_2$ are the number of such $R_1$ and $R_2$ groups and are from zero to four; and $m_1$ and $m_2$ are the number of such $Z_1$ and $Z_2$ groups on the benzene nucleus, and are from zero to two.

24. A process according to claim 1 in which the redox additive has a hydrophilic group.

25. A process according to claim 24 in which the hydrophilic group is a sulphonic acid group directly bound to an aromatic ring.

26. A process according to claim 24 in which the hydrophilic groups is in an aliphatic side chain directly bound to an aromatic ring.

27. A process according to claim 24 in which the redox additive is selected from the group consisting of anthraquinones and naphthoquinones with one or more hydroxy methyl and/or hydroxy ethyl and/or carboxylic groups bound to a methylene group and anthraquinones having one sulphonic acid group in an aliphatic side chain.

28. A process according to claim 1 in which after the preoxidation stage at least part of the preoxidation liquor is removed and reused in the preoxidation of freshly-added lignocellulosic material.

29. A process according to claim 1 in which spent preoxidation liquor from the preoxidation stage (1) is transferred to the alkaline digestion stage (4) and the redox additive for the preoxidation is also effective in the delignification stage.

30. A process according to claim 29 in which at least two redox additives are used, of which one is more effective in the delignification stage and the other more effective in the preoxidation stage.

31. A process according to claim 30 in which a mixture of hydrophilic and hydrophobic additives is used.

32. A process according to claim 31, in which the hydrophilic additive is present in the preoxidation stage, and the hydrophobic additive is added for the delignification stage.

33. A process according to claim 31 in which anthraquinone monosulphonic acid suitable for the preoxidation stage is used with anthraquinone suitable in the delignification stage.

34. A process according to claim 1 in which the amount of redox additive in the preoxidation stage and in the delignification stage is within the range from about 0.01 to 2% by weight based on dry lignocellulosic material.

35. A process according to claim 1 in which the amount of redox additive in the preoxidation stage and in the delignification stage is within the range from about 0.03 to about 0.5% by weight based on dry lignocellulosic material.

36. A process according to claim 1 in which the ratio of lignocellulosic material to liquor in both stages is between 1:2 and 1:20.

37. A process according to claim 1 in which the total addition of alkali in both stages is at least 10%.

* * * * *